US007736210B2

(12) United States Patent
Blick

(10) Patent No.: US 7,736,210 B2
(45) Date of Patent: Jun. 15, 2010

(54) MICROSCALE HIGH-FREQUENCY VACUUM ELECTRICAL DEVICE

(75) Inventor: Robert H. Blick, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 301 days.

(21) Appl. No.: 11/854,416

(22) Filed: Sep. 12, 2007

(65) Prior Publication Data

US 2008/0061700 A1 Mar. 13, 2008

Related U.S. Application Data

(60) Provisional application No. 60/843,991, filed on Sep. 12, 2006.

(51) Int. Cl.
*H01J 9/04* (2006.01)

(52) U.S. Cl. ..... 445/50; 445/51; 445/47; 445/46; 445/52

(58) Field of Classification Search ..... 315/5.36, 315/5.41, 5.43, 3.5, 5.14, 5.33, 111.31, 111.81; 313/459, 458, 441, 447, 448, 359.1, 360.1, 313/363.1, 146, 265; 345/75.1, 75.2, 74.1; 455/50, 51, 47, 46, 52, 24, 23
See application file for complete search history.

(56) References Cited

U.S. PATENT DOCUMENTS 5,036,263 A 7/1991 Yamada et al.
6,297,592 B1 * 10/2001 Goren et al. ..... 315/3.5
6,310,431 B1 10/2001 Blachet-Fincher et al.
6,335,595 B1 * 1/2002 Nishikawa et al. ..... 315/111.21
6,653,226 B1 11/2003 Reid
6,803,725 B2 10/2004 Jin
6,819,812 B2 11/2004 Kochergin et al.
6,946,693 B1 9/2005 Scheible et al.
6,987,027 B2 1/2006 Jin
7,078,862 B2 * 7/2006 Fukuda et al. ..... 315/111.21
2004/0245933 A1 * 12/2004 Voss et al. ..... 315/5.33
2005/0244094 A1 11/2005 Allsop et al.
2006/0057388 A1 3/2006 Jin et al.

OTHER PUBLICATIONS

PCT International Search Report for PCT/US07/78303, dated Apr. 25, 2008.

R. Allen Murphy, et al., Cold Cathode Microwave Devices, Vacuum Microelectronics, 2001, pp. 349-391, Chapter 8, John Wiley & Sons, Hoboken, NJ, USA.

Cha-Mei Tang, Microelectronic Applications for RF Sources and Accelerators, IEEE PAC95 Proceedings, 1995, pp. 70-74, IEEE, Washington, DC, USA.

D. V. Scheible, et al., Periodic Field Emission from an Isolated Nanoscale Electron Island, Physical Review Letters, vol. 93, No. 18, Oct. 29, 2004, pp. 1-4, The American Physical Society, College Park, MD, USA.

(Continued)

*Primary Examiner*—Tuyet Vo
(74) *Attorney, Agent, or Firm*—Boyle Fredrickson, S.C.

(57) ABSTRACT

A microscale vacuum electronic device (10) provides for a mechanical modulation of cathode (12) position with respect to the anode position, the anode electrically biased with respect to the cathode and held in an evacuated housing with the cathode, allowing improved high-frequency modulation of an electron beam (24) useful for vacuum electronic devices such as klystrons, klystrodes, and high frequency triodes.

18 Claims, 2 Drawing Sheets

OTHER PUBLICATIONS

Dominik V. Scheible, et al. Silicon Nanopillars for Mechanical Single-electron Transport, Applied Physics Letters, vol. 84, No. 23, Jun. 7, 2004, pp. 4632-4634, American Institute of Physics, Melville, NY, USA.

Schoeder et al., Abstract of "The Semiconductor Field-Emission Photocathode," Electron Devices, IEEE Transactions on Dec. 1974, vol. 21, Iss 12, pp. 785-798, Retrieved from http://ieeexplore.ieee.org/xpl on Feb. 11, 2008, IEEE, Washington, DC, USA.

* cited by examiner

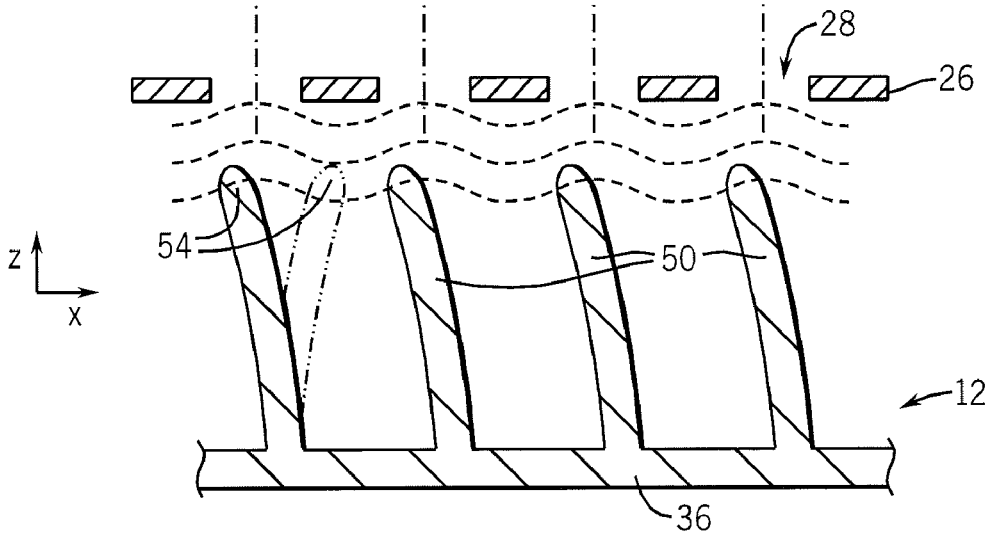
FIG. 4
FIG. 5
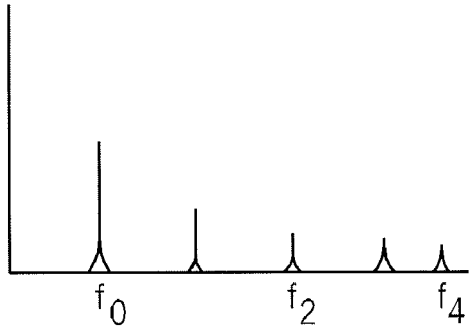
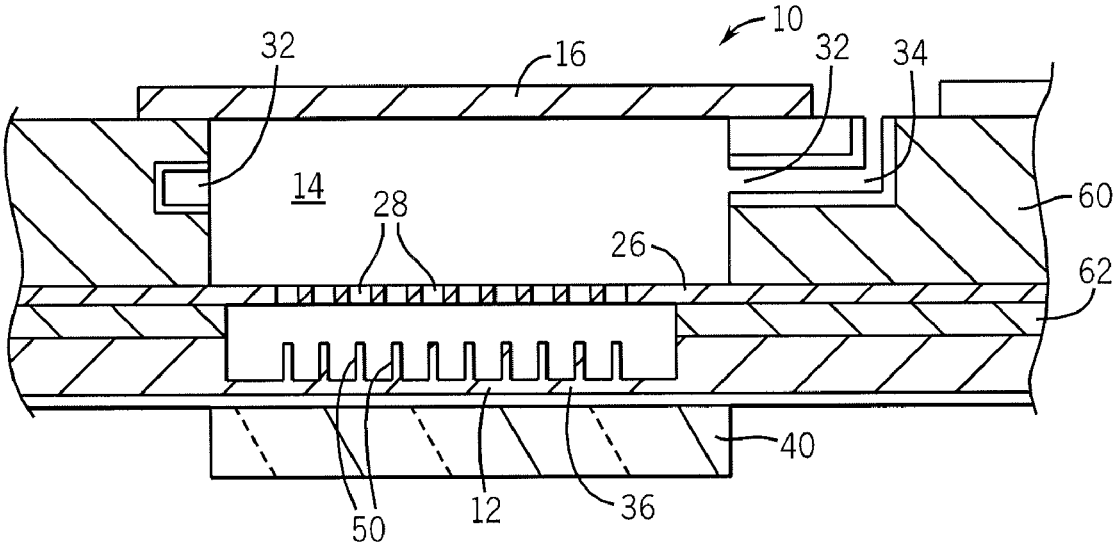
FIG. 6

MICROSCALE HIGH-FREQUENCY VACUUM ELECTRICAL DEVICE

CROSS-REFERENCE TO RELATED APPLICATIONS

This application claims the benefit of U.S. provisional application 60/843,991 filed Sep. 12, 2006 hereby incorporated by reference.

STATEMENT REGARDING FEDERALLY SPONSORED RESEARCH OR DEVELOPMENT

Background of the Invention

The present invention relates generally to high frequency vacuum electronics, including devices such as klystrons, klystrodes, and high frequency triodes and more specifically to a microscale vacuum electronic device employing mechanical modulation.

High-powered, high-frequency electrical signals may be created and controlled by vacuum electrical devices including vacuum tubes such as triodes, and traveling wave tubes, including generally magnetrons, klystron, klystrodes and the like.

One such device, the klystron, provides a cathode producing an electron beam directed toward an anode and then into a drift space. A high-frequency signal, for example at microwave frequencies, is introduced into a resonant cavity positioned along the path of the electron beam to velocity modulate the electrons of the beam. The velocity modulation "bunches" the electrons as they travel through the drift space after which they pass by and release energy to a second resonant cavity in amplified form.

In a conventional vacuum tube triode, a cathode produces an electron beam that is received by an anode after passing through a grid. A high-frequency signal may be applied to the grid to modulate the current emitted from the cathode and thus the current flowing from the cathode.

In a klystrode design, elements of the klystron and triode are combined so that the electron beam is velocity modulated with a grid and then passed through a drift space. As with the klystron, energy may be extracted from the bunched and accelerated electrons by a downstream resonant cavity.

The output of any of these devices may be applied as a feedback signal to the modulating grid or cavity to produce a high frequency oscillator.

Recent developments in such vacuum electrical devices have addressed the possibility of fabricating microscale vacuum electrical devices, using integrated circuit techniques and the like. The small scale of such devices allows extremely high frequency signals to be generated and controlled, but also raises a number of practical problems including tuning the device when used as an oscillator, which may require changing a microscale physical cavity size. Small scale devices also present problems of creating a hot cathode for thermionic emission, and problems inherent in the close spacing of the elements, for example the control grid to the cathode, such as may increase undesired electrical interactions.

BRIEF SUMMARY OF THE INVENTION

The present invention provides a microscale vacuum electrical device that employs mechanical modulation to control an electron beam. Mechanical modulation, as opposed to electrical modulation of a grid or coupled tuned cavity, offers the possibility of simplified device tuning. Further, by providing an electrically isolated modulation path, undesired electrical interactions among device signals can be reduced and circuit designs simplified.

Specifically, the present invention provides a microscale high-frequency vacuum electrical device having an evacuated housing holding a cathode and an anode. The anode is biased with respect to the cathode to attract an electron beam from the cathode. An actuator receives a first signal to modulate a relative location of a cathode, for example with respect to a grid or the anode, at a frequency greater than 50 kilohertz and for nanoscale devices to frequencies of up to 10 GHz, to modulate the electron beam.

It is thus one object of at least one embodiment of the invention to provide a vacuum electrical device that is better suited for microscale fabrication. Mechanical modulation makes possible device construction that can eliminate tuned coupling cavities, grid voltage modulation or the like.

The invention may provide a grid held within the housing between the cathode and anode and electromechanically biased to control the flow of electrons between the cathode and anode.

It is thus another object of at least one embodiment of the invention to provide a modified triode or klystrode type device.

The actuator may be a piezoelectric device.

It is thus an object of at least one embodiment of the invention to provide a simple solid-state actuator compatible with microscale devices and that may operate at high frequency.

The actuator may receive an electrical modulation signal.

It is an object of at least one embodiment of the invention to allow conventional electrical control and feedback of the vacuum electrical device.

The actuator may move the cathode.

It is thus an object of at least one embodiment of the invention to provide a simple method of modulating the cathode to grid distance by connection to the more accessible cathode structure.

The modulation of the electron beam may be at a harmonic frequency of the first signal driving the actuator.

It is thus an object of at least one embodiment of the invention to allow for high-frequency electron beam modulation above that readily obtained through physical motion of the actuator.

The cathode may include an array of field-emitting pillars extending toward the grid.

It is thus an object of at least one embodiment of the invention to improve the electron emissivity of the cathode through the use of nanoscale pillars.

The grid may include apertures aligned with the pillars so that movement of the pillar tips with respect to the apertures provides modulation of the electron beam.

It is thus another object of at least one embodiment of the invention to provide better electron beam modulation through relative movement of the pillars.

The pillar tips may move in flexure with respect to the apertures.

It is thus another object of at least one embodiment of the invention to provide a second resonant structure that may be used to modulate the electron beams.

The modulation of the electron beam by the pillars may be at a harmonic of a frequency of movement of a membrane forming the cathode.

It is thus an object of at least one embodiment of the invention to provide for higher frequency modulation than may be obtained by simple movement of the relatively larger cathode membrane.

The cathode and the pillars may be formed from a doped semiconductor.

Thus, it is an object of at least one embodiment of the invention to provide a structure that may be readily fabricated by conventional integrated circuit techniques.

The tips of the pillars may be coated with a material increasing the electron emissions of the pillars.

It is thus an object of at least one embodiment of the invention to provide for a high emissivity surface using both geometric and physical properties of the pillar material.

These particular objects and advantages may apply to only some embodiments falling within the claims and thus do not define the scope of the invention.

BRIEF DESCRIPTION OF THE DRAWINGS

FIG. 4 is an exaggerated cross-sectional fragmentary view of the grid and cathode of FIGS. 1 and 3, showing resonant motion of the pillars with movement of the cathode and their changing alignment with regularly spaced apertures within the grid;

FIG. 5 is a spectrum showing an operating frequency of a mechanical actuator and harmonics thereof which may drive ones of the cathode and the pillars at yet higher frequencies; and FIG. 6 is an elevational cross section of the device of FIG. 1 implemented using integrated circuit techniques.

DETAILED DESCRIPTION OF THE PREFERRED EMBODIMENT

Figure 1:
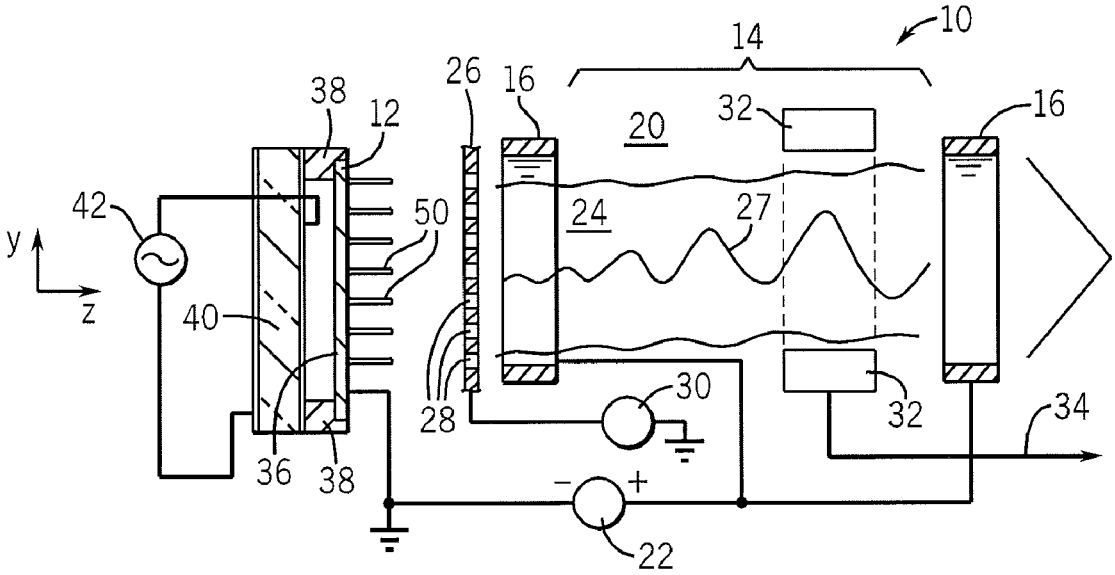
FIG. 1 is a side elevational view of a klystrode constructed according to the principles of the present invention, showing a cathode configured for mechanical movement with respect to a grid to provide a traveling wave directed toward an anode.

Referring now to FIG. 1, one embodiment of the invention may provide a klystrode 10 having a conductive cathode 12 opposed with one or more conductive anodes 16, defining between them a "drift space" 14, all held within an evacuated housing 20. The cathode 12 may be biased with respect to the anodes 16 by a DC bias source 22 as is understood in the art. Under the influence of the bias source 22, electrons are emitted from the cathode 12 and drawn in an electron beam 24 along a z-axis into the drift space 14.

The surface of the cathode may be of a type, as will be described below, to promote non-thermionic, low-temperature emission of electrons (field emissions) to provide for "cold cathode" operation. The cold operation of the cathode 12 allows it to be placed close to a grid 26, positioned between the cathode 12 and anode 16 so that electrons of the electron beam 24 must pass through apertures 28 in the grid before reaching the drift space 14.

In one possible operating mode, an RF modulating source 30 may be applied to the conductive grid 26, either capacitively or inductively, to both directly affect the emission of electrons from the cathode 12 and to promote a velocity difference in those electrons as they form the electron beam 24. The resulting modulated electron beam 24 is accelerated through the drift space 14 past an output cavity 32 positioned along the path of the electron beam 24. The output cavity 32 is tuned to a modulation frequency of the electron beam 24 to extract amplified radio frequency energy from the electron beam 24 through output waveguide 34 according to techniques well understood in the art. A portion of the signal on the waveguide 34 may be fed back to drive the grid 26 to produce an oscillator or may be appropriately divided in frequency and used to drive the mechanical resonance.

As is understood in the art, modulation of the grid 26, by RF modulating source 30 alters the velocity of the electrons emitted from the cathode 12 so that there is a bunching of electrons as the electrons move through drift space 14. The bunching is shown by superimposed plot 27. The modulation voltage on the grid 26 may also affect the emission of electrons from the cathode 12 causing a current modulation. Electron energy recovered from the cavity 32 is thus amplified both by changes in kinetic energy and changes in current flow.

Figure 3:
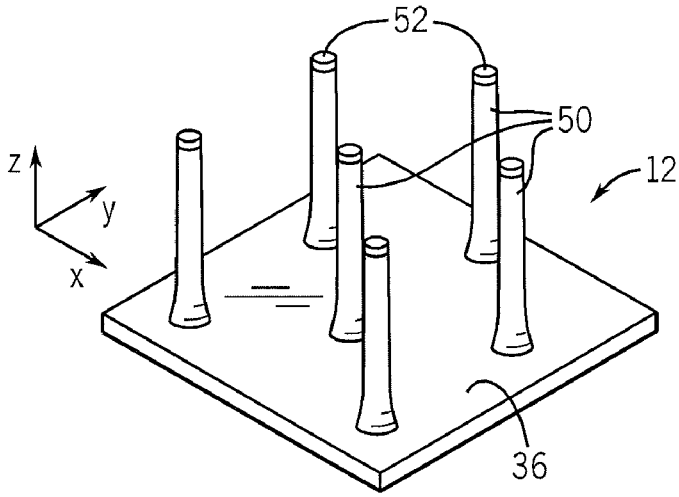
FIG. 3 is a fragmentary perspective view of the surface of the cathode facing the grid showing fabrication of a plurality of nanoscale pillars on that surface.

Referring now to FIGS. 1 and 3, in the present invention, the cathode 12 includes a substrate membrane 36 extending generally along an x-y plane orthogonal to the z-axis along which the electron beam 24 travels. The membrane 36 may be supported, for example, at its edges by a collar 38 attached to a piezoelectric actuator 40 parallel to the membrane 36 on the opposite side of the membrane 36 with respect to the anodes 16 and driven by a modulation source 42.

The modulation source 42 causes z-axis motion of the membrane 36 at ultrasonic frequencies of 50 kilohertz and above and frequencies up to 10 GHz. The effect of this actuation is to change the spacing between the cathode 12 and the grid 26, thereby modulating the effect of the electrical field of the grid 26 on the cathode 12 and thus changing the velocity of the electrons emitted therefrom and to some extent the emissions from the cathode 12.

Figure 2:
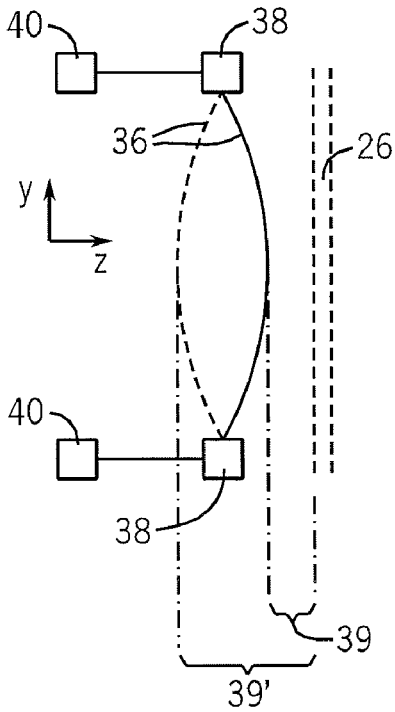
FIG. 2 is a simplified diagram of the cathode and anode showing one resonant motion of the cathode when excited by a piezoelectric actuator.

Referring now to FIG. 2, the membrane 36 as supported at its edges by collar 38 for movement along the z-axis may exhibit resonant behavior defined by its geometry, stiffness and distributed mass. As shown in FIG. 2, this resonant motion changes the spacing of the cathode 12 to the grid 26 from a minimum value of 39 to a maximum value 39' that may exceed the actual motion of the actuator 40. Further, and referring momentarily to FIG. 5, this resonant behavior allows, for example, the actuator to operate at a first frequency $f_0$ and for motion of the membrane 36 to follow a harmonic $f_2$ and thus to modulate the electron beam at frequencies much exceeding those obtainable by the actuator 40.

Referring now to FIGS. 3 and 4, the surface of the membrane 36 facing the grid 26 may be populated with a set of pillars 50 extending outward from the surface of the membrane 36, along the z-axis. The pillars 50 are nanostructures having, for example, diameters less than 1000 nanometers and typically less than tens of nanometers at their tips, and heights many times their diameters. The small size of the tips of the pillars 50 produce field emissions that differ from those predicted by the classical Fowler-Nordheim model, as described in D. V. Scheible et al., Physical Review Letters vol. 93, 186801 (2004) hereby incorporated by reference.

The membrane 36 and pillars 50 may be fabricated using integrated circuit techniques (e.g. lithography) or growth of nanostructures, for example carbon nanotubes, at catalysts deposited on the membrane 36 at regular locations. Two techniques for fabrication are described in U.S. Pat. Nos. 6,946,693 and 6,858,521 hereby incorporated by reference. A high emissivity capping material 52 may be placed at the tips of the pillars 50, for example, gold, diamond, or semiconductor materials, to improve their emission qualities.

Referring now to FIG. 4, the pillars 50 may be located to align axially (at rest) with corresponding apertures 28 in the grid 26 so that the grid 26 may pass electrons from the tips of the pillars 50 through the apertures without striking the grid 26 and providing unnecessary heating of the grid 26. Control of the grid voltage, may nevertheless be used to control the velocity and/or current of the electron beam 24.

Referring still to FIG. 4, like the membrane 36, the pillars 50 may exhibit their own resonant behavior, vibrating in one or more modes along the x-y plane, for example between locations 54. Referring again to FIG. 5, the smaller size of the pillars 50 allow them to resonate at a higher harmonic, for example, $f_4$ of the actuator frequency $f_0$, so that frequencies in excess of 100 megahertz and as much as several terahertz may be obtained.

The motion of the pillars 50 changes their alignment with respect to the apertures 28 in the grid 26 and the relative field strength of the grid field on their tips. This change in field strength also modulates the electron velocity and/or current from the pillars 50 and thus the motion of the tips of the pillars 50 with respect to the apertures provides additional modulation or the principal modulation of the electron beam.

Referring now to FIG. 6, the present device is well adapted to fabrication using integrated circuit techniques. In such an integrated device, the cathode 12 may be fabricated of a doped semiconductor substrate with pillars 50 formed by lithographic techniques and the actuator 40 bonded to the bottom surface of the substrate. An insulating spacer layer 62 may be bonded to the upper surface of the substrate of the cathode 12 and used to space a grid 26 from the cathode 12, the latter which may be etched to form apertures 28 aligned with the pillars 50 and then metallized or doped to provide conductivity. A second spacer layer 60 may then be used to create the drift space 14 and to support a conductive anode 16. A cavity 32 etched in the spacer layer 60 provides an output for the klystrode 10.

In an alternative embodiment, the pillars 50 may incorporate multiple quantum wells, for example, by layering materials along the axis of the pillars 50, to produce a quantum resonant tunneling device in which extremely low field emissions occur at non-resonant voltages and large field emissions occur at resonant voltages. These selective emissions characteristics could enable ultra low noise field emission currents by setting the DC electric field between the tips of the pillars 50 and grid 26 (when the pillars 50 are at rest) just below a resonant voltage thereby producing a very low "dark" current. Ultrasonic excitation would then move the tips of the pillar 50 into a field that provides a resonant voltage allowing precisely modulated field emissions with low noise.

Another possibility is that of using phonon or photon assisted tunneling (PAT) through the quantum wells of the pillars 50 as controlled by a coupled piezoelectric actuator 40 or a stimulating light source. This mechanism as detected in quantum dots is described in H. Qin et al., Physical Review B vol. 64, R241302 (2001) hereby incorporated by reference.

An individual piezoelectric actuator 40 could be associated with each pillar 50 or each small group of pillars 50 in order to provide individual control of the field emissions of the pillars or groups, for example, to realize uniform field emission across the cathode area. In one embodiment the pillars 50 may be placed on top of a piezoelectric substrate such as quartz or the piezoelectric substrate may be etched or formed directly to produce the pillars 50.

It will be understood that these techniques may be used with other traveling wave type tubes such as klystrons and, in fact, with other vacuum tube-type devices such as triodes in which directed mechanical modulation may be practical for nanoscale-sized structures. In the klystrode and triode, the grid may be held at a constant voltage or modulated to augment the mechanical modulation of the cathode. Clearly in these devices, the grids could also be mechanically modulated or another field generating structure could be modulated including the anode. Modulation of the pillars may be used alone and promoted by an actuator connection providing movement not in the z-axis but in the x or y-axis.

It is specifically intended that the present invention not be limited to the embodiments and illustrations contained herein, but include modified forms of those embodiments including portions of the embodiments and combinations of elements of different embodiments as come within the scope of the following claims.

I claim:

1. A microscale high-frequency vacuum electrical device comprising:

an evacuated housing;

a cathode held within the housing;

an anode held within the housing to be electrically biased with respect to the cathode to attract an electron beam from the cathode; and an actuator receiving a first signal to modulate a relative position of the cathode at a frequency greater than 100 kHz to modulate the electron beam;

further including a grid held within the housing between the cathode and anode to be electrically biased to control flow of electrons between the cathode and anode; and wherein the cathode's position is modulated with respect to the grid.

2. The high-frequency vacuum electrical device of claim 1 wherein the actuator is a piezoelectric device.

3. The high-frequency vacuum electrical device of claim 1 wherein the actuator receives an electrical modulation signal.

4. The high-frequency vacuum electrical device of claim 1 wherein the actuator moves the cathode.

5. The high-frequency vacuum electrical device of claim 1 wherein the modulation of the electron beam is at a harmonic of a frequency of the first signal.

6. The high-frequency vacuum electrical device of claim 1 wherein the cathode further includes a substrate supporting an array of field emitting pillars extending along the electron beam.

7. The high-frequency vacuum electrical device of claim 6 wherein the modulation of the electron beam by the pillars is at a harmonic of a frequency of movement of the substrate.

8. The high-frequency vacuum electrical device of claim 6 wherein the cathode and pillars are formed from a doped semiconductor.

9. The high-frequency vacuum electrical device of claim 6 wherein the grid includes apertures aligned with the pillars whereby movement of pillar tips with respect to the apertures provides modulation of the electron beam.

10. The high-frequency vacuum electrical device of claim 9 wherein the pillar tips move in flexure with respect to the apertures.

11. A microscale high-frequency vacuum electrical device comprising:

an evacuated housing;

a cathode held within the housing;

an anode held within the housing to be electrically biased with respect to the cathode to attract an electron beam from the cathode; wherein the cathode further includes a substrate holding an array of field emitting pillars extending substantially toward the anode; and an actuator receiving a first signal to move the pillars a frequency greater than 100 kHz to modulate the electron beam received by the anode;

further including a grid held within the housing between the cathode and anode to be electrically biased to control flow of electrons between the cathode and anode.

12. The high-frequency vacuum electrical device of claim 11 wherein the modulation of the electron beam by the pillars is at a harmonic of a frequency of movement of the substrate.

13. The high-frequency vacuum electrical device of claim 11 wherein the cathode and pillars are formed from a doped semiconductor.

14. The high-frequency vacuum electrical device of claim 11 wherein tips of the pillars are coated with a material increasing the electron emissions of the pillars.

15. The high-frequency vacuum electrical device of claim 11 wherein the pillars have a width of less than 1000 nanometers.

16. The high-frequency vacuum electrical device of claim 11 wherein the grid includes apertures aligned with the pillars whereby movement of pillar tips with respect to the apertures provides modulation of the electron beam.

17. The high-frequency vacuum electrical device of claim 16 wherein the pillar tips move in flexure with respect to the apertures.

18. The high-frequency vacuum electrical device of claim 16 wherein the pillar tips are coated with a high emissivity material.

* * * * *